US009383714B1

(12) United States Patent
Sato

(10) Patent No.: US 9,383,714 B1
(45) Date of Patent: Jul. 5, 2016

(54) CLEANING APPARATUS FOR IMAGE CARRIER, IMAGE FORMING APPARATUS HAVING THE SAME, AND METHOD FOR CLEANING IMAGE CARRIER

(71) Applicants: KABUSHIKI KAISHA TOSHIBA, Tokyo (JP); TOSHIBA TEC KABUSHIKI KAISHA, Tokyo (JP)

(72) Inventor: Yoji Sato, Izunokuni Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/699,976

(22) Filed: Apr. 29, 2015

(51) Int. Cl.
*G03G 21/00* (2006.01)
*G03G 15/16* (2006.01)

(52) U.S. Cl.
CPC ..... *G03G 21/0052* (2013.01); *G03G 15/161* (2013.01); *G03G 2215/1661* (2013.01)

(58) Field of Classification Search
CPC ..... G03G 15/161; G03G 21/0052; G03G 2215/1647; G03G 2215/1661
USPC ..... 399/92, 101, 358
See application file for complete search history.

(56) References Cited

U.S. PATENT DOCUMENTS

| | | | | |
|---|---|---|---|---|
| 4,264,190 | A * | 4/1981 | Tsuda | G03G 21/0035 15/256.52 |
| 5,646,718 | A * | 7/1997 | Suwa et al. | 399/350 |
| 2005/0180785 | A1 | 8/2005 | Murakami et al. | |
| 2007/0201897 | A1 * | 8/2007 | Maeda et al. | 399/101 |
| 2010/0008706 | A1 | 1/2010 | Sugiura et al. | |

FOREIGN PATENT DOCUMENTS

| | | | | |
|---|---|---|---|---|
| JP | 05181396 | A * | 7/1993 | G03G 21/00 |
| JP | 2000338836 | A | 12/2000 | |
| JP | 2005173543 | A | 6/2005 | |
| JP | 2006330216 | A | 12/2006 | |
| JP | 2013142785 | A | 7/2013 | |

* cited by examiner

*Primary Examiner* — Benjamin Schmitt
(74) *Attorney, Agent, or Firm* — Patterson & Sheridan, LLP

(57) ABSTRACT

A cleaning apparatus for an image carrier with toner on the image carrier, includes a cleaning member that is in contact with the image carrier and configured to remove toner on the image carrier as the image carrier moves in a conveying direction, and an air blower configured to generate an air flow in a region of the image carrier that is moving towards the cleaning member.

14 Claims, 11 Drawing Sheets

CLEANING APPARATUS FOR IMAGE CARRIER, IMAGE FORMING APPARATUS HAVING THE SAME, AND METHOD FOR CLEANING IMAGE CARRIER

FIELD

Embodiments described herein relate generally to a cleaning apparatus for an image carrier, an image forming apparatus having the same, and a method for cleaning an image carrier.

BACKGROUND

An image forming apparatus forms a toner image on an image carrier, such as a transfer belt and a photoreceptor, before the toner image is transferred to a medium (e.g., paper). One type of the image forming apparatus has a cleaning member (e.g., a cleaning blade) that is in contact with the image carrier and removes toner remaining on the image carrier as the image carrier moves after the toner image is transferred to the medium.

As the cleaning member is in contact with the image carrier that moves, there is friction between them. As the friction becomes larger, the cleaning capability of the cleaning member tends to decrease. For example, when a blade is used for the cleaning member, the blade curls up when the friction is large and the curled blade may not have very good cleaning capability. Further, the friction between the cleaning member and the image carrier is not uniform and tends to be larger at an end region of the image carrier where the toner image is not formed.

DETAILED DESCRIPTION

Figure 1:
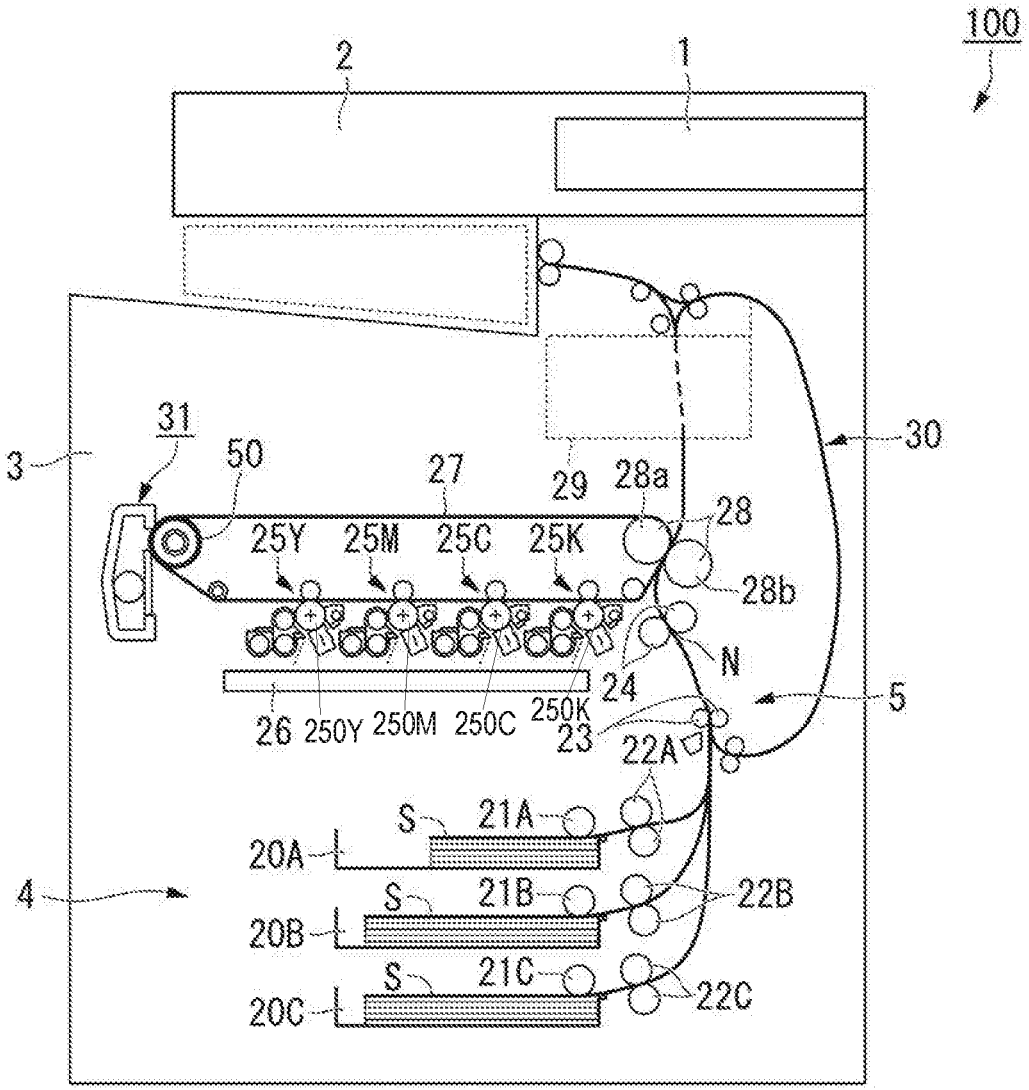
FIG. 1 is a schematic cross-sectional view of an image forming apparatus according to a first embodiment.

In general, according to one embodiment, a cleaning apparatus for an image carrier with toner thereon, includes a cleaning member that is in contact with the image carrier and configured to remove toner on the image carrier as the image carrier moves in a conveying direction, and an air blower configured to generate an air flow in a region of the image carrier that is moving towards the cleaning member.

First Embodiment

Hereinafter, an image forming apparatus 100 according to a first embodiment is described with reference to the drawings. In the drawings, the same configurations have the same reference numerals.

FIG. 1 is a schematic cross-sectional view of the image forming apparatus 100 according to the first embodiment.

As illustrated in FIG. 1, the image forming apparatus 100 includes a control panel 1, a scanner 2, a printer 3, a sheet container 4, and a transport mechanism 5.

The scanner 2 generates image data of a copy target based on brightness of light received. The scanner 2 outputs the generated image data to the printer 3.

The printer 3 forms an output image (hereinafter referred to as a toner image) by using a developer containing toner or the like, based on the image data from the scanner 2 or image data from an external device. The printer 3 transfers the toner image onto the front surface of a sheet S. The printer 3 applies heat and pressure to the toner image on the front surface of the sheet S to fix the toner image on the sheet S.

The sheet container 4 supplies the sheets S one by one to the printer 3 in accordance with timing of forming the toner image by the printer 3. The sheet container 4 includes a plurality of sheet cassettes 20A, 20B, and 20C. Each of the sheet cassettes 20A, 20B, and 20C stores sheets S of a preset size and type. The sheet cassettes 20A, 20B, and 20C include pick-up rollers 21A, 21B, and 21C, respectively. The pick-up rollers 21A, 21B, and 21C pull out the sheets S one by one from the sheet cassettes 20A, 20B, and 20C, respectively. The pick-up rollers 21A, 21B, and 21C convey the pulled-out sheet S to the transport mechanism 5.

The transport mechanism 5 includes a transport roller 23 and a registration roller 24. The transport mechanism 5 transports the sheet S that is conveyed from the pick-up rollers 21A, 21B, and 21C to the registration roller 24. The registration roller 24 transports the sheet S in accordance with the timing of transferring the toner image onto the sheet S by the printer 3. The transport roller 23 causes the tip end of the sheet S in the transport direction to contact a nip N of the registration roller 24. The transport roller 23 causes the sheet S to be bent such that a position of the tip end of the sheet S in the transport direction is adjusted. The registration roller 24 adjusts the tip end of the sheet S that is conveyed from the transport roller 23 at the nip N. Further, the registration roller 24 transports the sheet S towards a transfer unit 28, which will be described later.

The printer 3 includes image forming units 25Y, 25M, 25C, and 25K, a light-exposure unit 26, an intermediate transfer belt 27 (image carrier), a transfer unit 28, a fixing device 29, and a transfer belt cleaning unit 31.

Each of the image forming units 25Y, 25M, 25C, and 25K forms on the intermediate transfer belt 27 a toner image that is transferred onto the sheet S. The intermediate transfer belt 27 is an endless belt. The intermediate transfer belt 27 is stretched with a tension by a plurality of rollers which are in contact with inner surface thereof. The intermediate transfer belt 27 is stretched flatly in a width direction thereof. The inner surface of the intermediate transfer belt 27 is in contact with a support roller 28*a* and a transfer belt roller 50 at positions that are farthest from each other in a stretched direction.

From here on, a width in the intermediate transfer belt 27 in the longitudinal direction (direction along the center axis) of the transfer belt roller 50 is simply referred to as a width of the intermediate transfer belt 27. A direction along the width of the intermediate transfer belt 27 is referred to as a width direction of the intermediate transfer belt 27. A size of an image forming region (toner image forming region based on the image information) in the width direction of the intermediate transfer belt 27 is referred to as a width of the image forming region.

A direction that is along the surface of the intermediate transfer belt 27 and orthogonal to the width direction of the intermediate transfer belt 27 is referred to as a circumferential direction of the intermediate transfer belt 27. The width of the intermediate transfer belt 27 is wider than the width of the image forming region.

The support roller 28*a* is a part of the transfer unit 28, which will be described later. The support roller 28*a* guides a portion of the intermediate transfer belt 27 to a secondary transfer position.

The transfer belt roller 50 guides a portion of the intermediate transfer belt 27 to a cleaning position.

The image forming units 25Y, 25M, 25C, and 25K are disposed below (in FIG. 1) the intermediate transfer belt 27 in this order in a direction from the transfer belt roller 50 to the transfer unit 28. The image forming units 25Y, 25M, 25C, and 25K are disposed to be spaced from one another below a region the intermediate transfer belt 27 between the transfer belt roller 50 and the support roller 28*a*.

Each developing unit of the image forming units 25Y, 25M, 25C, and 25K supplies toner on the front surface of a corresponding photoreceptor drum (250Y, 250M, 250C, and 250K, respectively, and generally 250 in FIG. 1). The developing units retain toners of yellow, magenta, cyan, and black, respectively.

A charger, a developing unit, a transfer roller, a photoreceptor cleaning unit (See FIGS. 10 and 11), and a static eliminator are disposed around each photoreceptor drum 250.

Each developing unit of the image forming units 25Y, 25M, 25C, and 25K supplies toner on the front surface of a corresponding photoreceptor drum 250. The developing units retain toners of yellow, magenta, cyan, and black, respectively.

The light-exposure unit 26 is disposed opposite to the photoreceptor drum 250 of each of the image forming units 25Y, 25M, 25C, and 25K. The front surface of the photoreceptor drum 250 of each of the image forming units 25Y, 25M, 25C, and 25K is irradiated with a laser beam from the light-exposure unit 26, which is emission-controlled based on the image information. The image data of yellow, magenta, cyan, and black is supplied to the light-exposure unit 26. The photoreceptor drums 250 of the image forming units 25Y, 25M, 25C, and 25K are irradiated with the laser beam from the light-exposure unit 26 based on the image data of yellow, magenta, cyan, and black after charging. The light-exposure unit 26 forms an electrostatic latent image on the surface of each photoreceptor drum 250 based on the image data.

The image forming unit 25Y develops an electrostatic latent image formed by the laser beam from the light-exposure unit 26, using the yellow toner. The image forming unit 25Y forms a yellow toner image on the surface of the photoreceptor drum 250. The image forming unit 25M develops an electrostatic latent image formed by the laser beam from the light-exposure unit 26, using the magenta toner. The image forming unit 25M forms a magenta toner image on the surface of the photoreceptor drum 250. The image forming unit 25C develops an electrostatic latent image formed by the laser beam from the light-exposure unit 26, using the cyan toner. The image forming unit 25C forms a cyan toner image on the surface of the photoreceptor drum 250. The image forming unit 25K develops an electrostatic latent image formed by the laser beam from the light-exposure unit 26, using the black toner. The image forming unit 25K forms a black toner image on the surface of the photoreceptor drum 250.

The image forming units 25Y, 25M, 25C, and 25K transfer (primarily transfer) the toner images on the surfaces of the photoreceptor drums 250 onto the intermediate transfer belt 27. The image forming units 25Y, 25M, 25C, and 25K apply transfer bias to the toner images at primary transfer positions, respectively. The image forming units 25Y, 25M, 25C, and 25K superimpose and transfer the toner images of each color onto the intermediate transfer belt 27. As a result, the image forming units 25Y, 25M, 25C, and 25K form a color toner image on the intermediate transfer belt 27.

The transfer unit 28 is disposed at a position of the intermediate transfer belt 27 which neighbors the image forming unit 25K.

The transfer unit 28 transfers the toner image which is charged on the intermediate transfer belt 27 onto the front surface of the sheet S at a secondary transfer position. The secondary transfer position is a position where the support roller 28*a* faces the secondary support roller 28*b*. The transfer unit 28 applies transfer bias that is controlled by a transfer current to the secondary transfer position. The transfer unit 28 transfers the toner image on the intermediate transfer belt 27 onto the sheet S by the transfer bias.

The fixing device 29 fixes the toner image on the front surface of the sheet S to the sheet S using heat and pressure.

The printer 3 includes a reverse unit 30. The reverse unit 30 turns over the sheet S that is discharged from the fixing device 29 through a switchback. The reverse unit 30 transports the turned-over sheet S along a transport guide in front of the registration roller 24. The reverse unit 30 turns over the sheet S so that an image can be formed on the rear surface.

The transfer belt cleaning unit 31 is disposed at a position that is separated from but neighbors the image forming unit 25Y along the intermediate transfer belt 27. The transfer belt cleaning unit 31 scrapes toner remaining on the outer surface of the intermediate transfer belt 27. The transfer belt cleaning unit 31 stores the scraped toner in waste toner tank.

Next, a configuration of the transfer belt cleaning unit 31 will be described.

Figure 2:
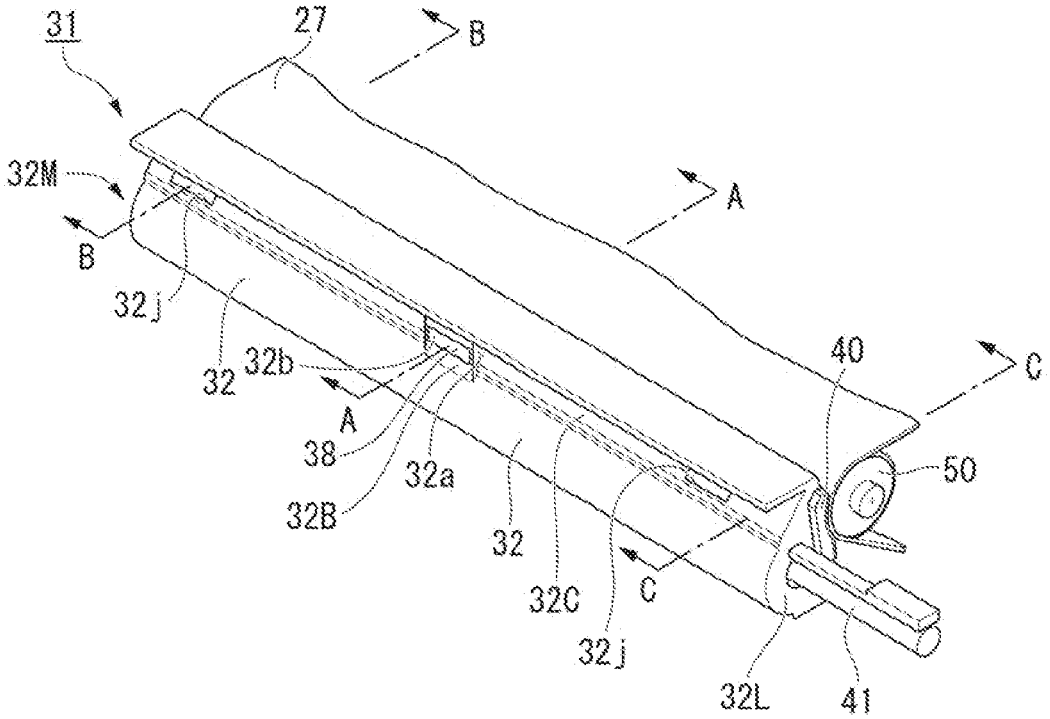
FIG. 2 is a schematic perspective view of a transfer belt cleaning unit of the image forming apparatus according to the first embodiment.
Figure 3:
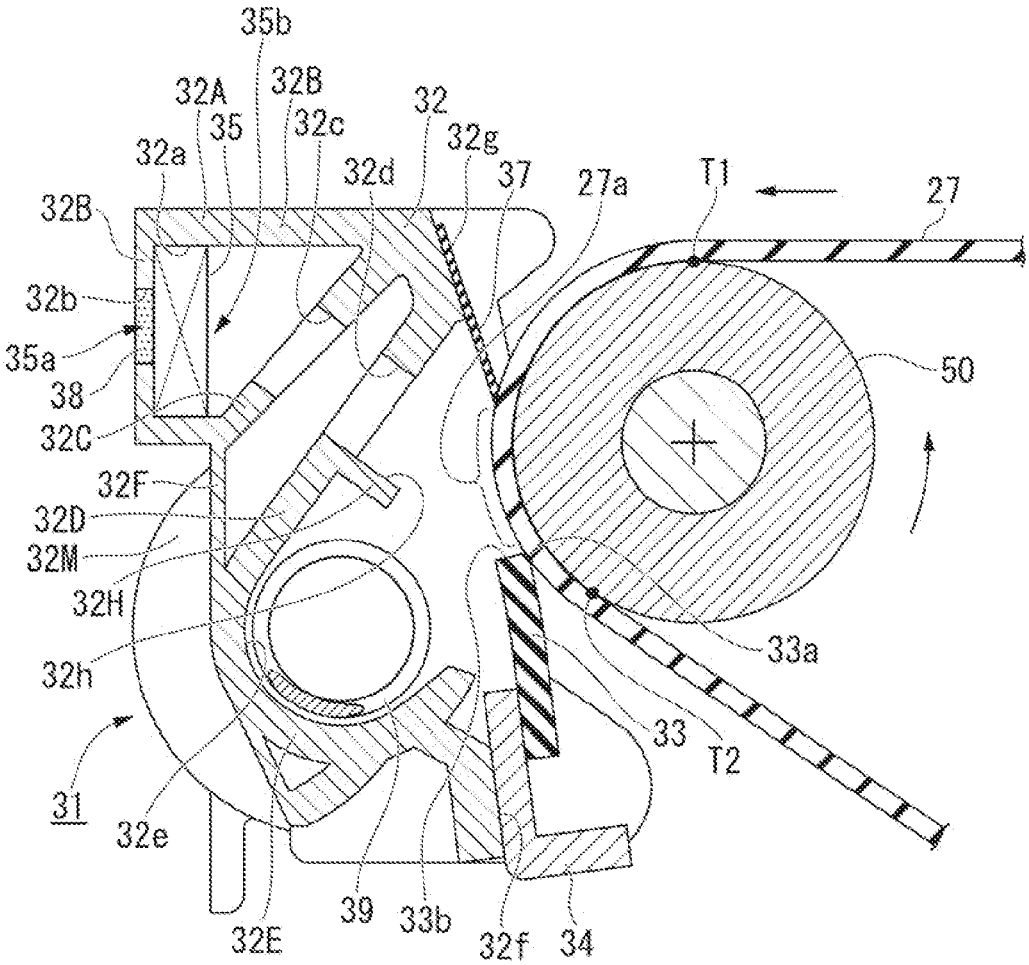
FIG. 3 is a schematic cross-sectional view of the transfer belt cleaning unit taken along line A-A in FIG. 2.
Figure 4:
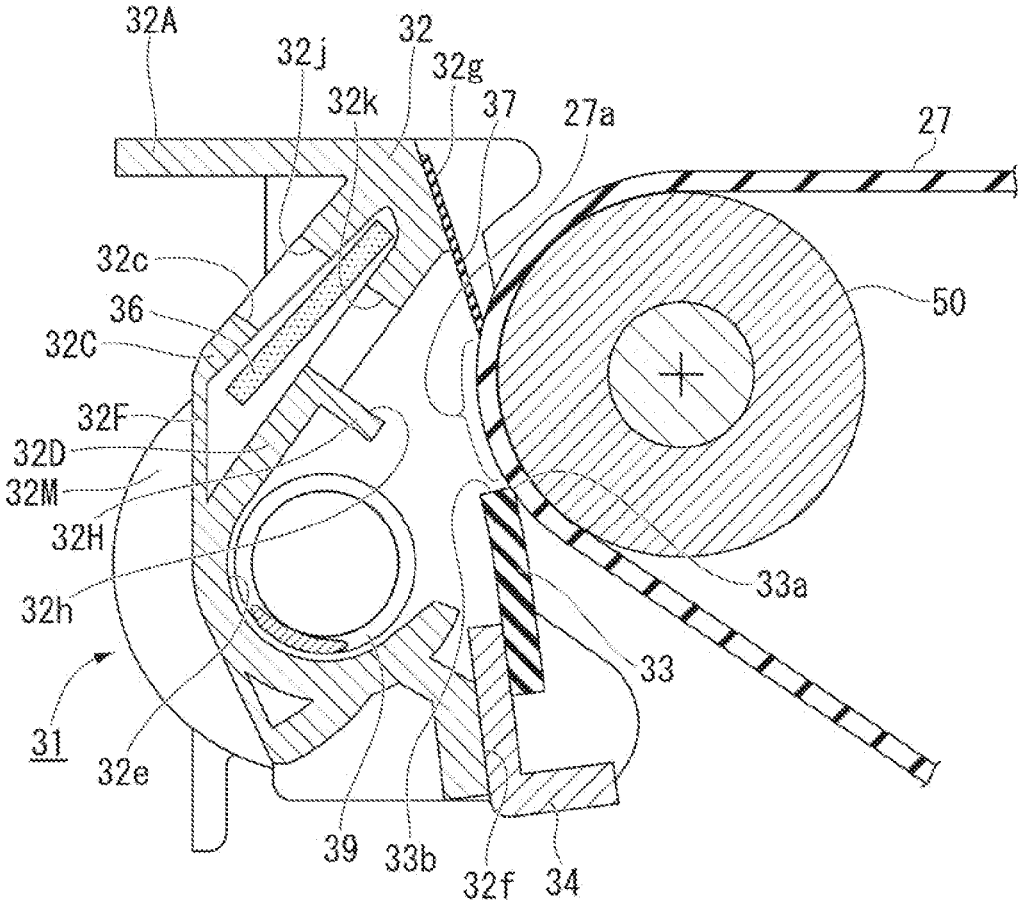
FIG. 4 is a schematic cross-sectional view of the transfer belt cleaning unit taken along line B-B in FIG. 2.
Figure 5:
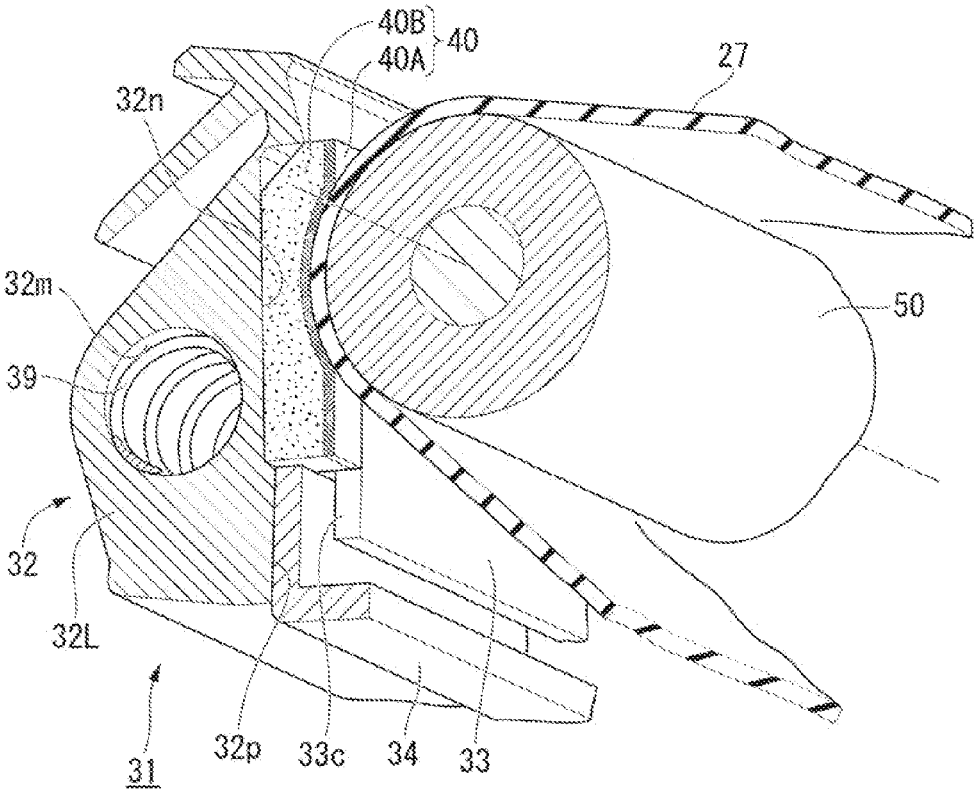
FIG. 5 is a schematic perspective cross-sectional view of the transfer belt cleaning unit taken along line C-C in FIG. 2.

FIG. 2 is a schematic perspective view of the transfer belt cleaning unit of the image forming apparatus according to the first embodiment. FIG. 3 is a schematic cross-sectional view of the transfer belt taken along line A-A in FIG. 2. FIG. 4 is a schematic cross-sectional view of the transfer belt taken along line B-B in FIG. 2. FIG. 5 is a schematic perspective cross-sectional view of the transfer belt taken along line C-C in FIG. 2. The cross-section views are taken along line A-A, line B-B, and line C-C in FIG. 2, respectively, and illustrate in-plane cross sections orthogonal to the longitudinal direction of the transfer belt cleaning unit 31.

As illustrated in FIGS. 1 and 2, the transfer belt cleaning unit 31 is disposed at a position facing the transfer belt roller 50 across the intermediate transfer belt 27.

As illustrated in FIG. 3, the transfer belt cleaning unit 31 includes a cleaning blade 33, a frame body 32, and a fan 35.

The cleaning blade 33 is in contact with the intermediate transfer belt 27 and scrapes toner on the intermediate transfer belt 27. The cleaning blade 33 is formed of a plate-like rubber material having an elongated rectangular shape.

The length of the cleaning blade 33 in the longitudinal direction is longer than the width of the image forming region in the intermediate transfer belt 27. The length of the cleaning blade 33 in the longitudinal direction is shorter than the width of the intermediate transfer belt 27.

The transfer belt cleaning unit 31 includes a holder 34 to which the cleaning blade 33 is fixed. The holder 34 includes a plate-like portion to which the cleaning blade 33 is fixed. For example, the holder 34 is formed of an angle member that is bent in an L shape and formed of a metal plate that is longer than the cleaning blade 33.

The cleaning blade 33 is fixed to the plate-like portion of the holder 34 at an end portion in the short direction thereof. In the cleaning blade 33, an end portion opposite to the end portion fixed to the holder 34 protrudes from the plate-like portion of the holder 34. The cleaning blade 33 can be deformed in an out-of-plane direction with respect to the plate-like portion of the holder 34.

The frame body 32 is fixed to a position separated by a certain distance from the transfer belt roller 50 in the printer 3. The frame body 32 is disposed at a position facing the transfer belt roller 50 across the intermediate transfer belt 27 and in a lower side region thereof.

Hereinafter, a region where the inner surface of the intermediate transfer belt 27 is in contact with the transfer belt roller 50 is referred to as a wound portion. In the circumferential direction of the intermediate transfer belt 27, the wound portion begins at a contact position T1 in the upper region of the transfer belt roller 50. In the circumferential direction of the intermediate transfer belt 27, the wound portion ends at a contact position T2 in the lower region of the transfer belt roller 50.

A holder attaching portion 32*f*, a recovery sheet attaching portion 32*g*, a toner accommodating portion 32*e*, and a fan accommodating portion 32*a* are formed in the frame body 32.

The holder attaching portion 32*f* is formed in a lower side region (illustrated in the drawings) of the frame body 32. The holder 34 is fixed to the holder attaching portion 32*f*. The position of the holder 34 and the cleaning blade 33 is defined by the holder attaching portion 32*f*.

The frame body 32 holds the cleaning blade 33 through the holder 34 fixed to the holder attaching portion 32*f*. The cleaning blade 33 extends toward the intermediate transfer belt 27. The tip end of the cleaning blade 33 is positioned on the outer surface closer to a finishing end of the wound portion of the intermediate transfer belt 27. An edge 33*a* of the cleaning blade 33, which is formed on a corner of the tip end of the cleaning blade 33, is in contact with the intermediate transfer belt 27 and extends in a direction perpendicular to a moving direction of the intermediate transfer belt 27 moves. A tip end surface 33*b* of the cleaning blade 33 faces a side opposite to the moving direction of the intermediate transfer belt 27.

The recovery sheet attaching portion 32*g* is formed on the upper side (illustrated in the drawings) of the frame body 32. A sheet-like recovery sheet 37 is fixed to the recovery sheet attaching portion 32*g*. The position of the recovery sheet 37 is defined by the recovery sheet attaching portion 32*g*.

The recovery sheet 37 has an elongated rectangular shape. The recovery sheet 37 has the same length as the cleaning blade 33. For example, the recovery sheet 37 is formed of a resin film.

An end of the recovery sheet 37 in the short direction thereof is fixed to the recovery sheet attaching portion 32*g*. The recovery sheet 37 extends towards the intermediate transfer belt 27. The recovery sheet 37 is into contact with the wound portion of the intermediate transfer belt 27. The contact position of the recovery sheet 37 is closer to the beginning end of the wound portion than the contact position of the edge 33*a* of the cleaning blade 33 is.

The toner accommodating portion 32*e* is a concave portion including a U-shaped cross section formed of a partition wall portion 32D and a curved portion 32E. The partition wall portion 32D and the curved portion 32E extend in the longitudinal direction of the frame body 32. As illustrated in FIG. 2, an end of the toner accommodating portion 32*e* in the longitudinal direction thereof is closed with a plate-like front side wall portion 32L and a plate-like rear side wall portion 32M.

As illustrated in FIG. 3, the partition wall portion 32D is a plate-like portion. The partition wall portion 32D extends obliquely downward (illustrated in the drawings) from an end of the recovery sheet attaching portion 32*g*, which is closer to the intermediate transfer belt 27. The curved portion 32E has a circular arc-shaped cross section orthogonal to the longitudinal direction. The curved portion 32E is receded from the intermediate transfer belt 27 between an end of the partition wall portion 32D and the holder attaching portion 32*f*.

The toner accommodating portion 32*e* stores toner that is scraped by the cleaning blade 33.

In the toner accommodating portion 32*e*, an auger 39 is disposed on the inner side of the curved portion 32E. The auger 39 transports the stored toner in the toner accommodating portion 32*e* by being driven to rotate. According to the present embodiment, the auger 39 transports the toner to the front side (front side of the paper surface of FIG. 3) of the printer 3. As illustrated in FIG. 2, a pipe-like scrap tonner guide 41 protrudes on the front side of the front side wall portion 32L. An end of the auger 39, which extends out from the toner accommodating portion 32*e*, is inserted into the inside of the scrap tonner guide 41. The scrap tonner guide 41 guides the toner that is transported by the auger 39 to the outside of the frame body 32. The scrap tonner guide 41 is connected to the waste toner tank. Toner that moves in the scrap tonner guide 41 is stored in the waste toner tank.

An outer wall portion 32C and a flat plate portion 32A are connected to an end of the recovery sheet attaching portion 32*g* in the short direction thereof, which is receded from the intermediate transfer belt 27. The outer wall portion 32C is a flat plate extending in the same oblique direction as the partition wall portion 32D. The flat plate portion 32A extends in the horizontal direction. As illustrated in FIG. 2, the outer wall portion 32C and the flat plate portion 32A are formed along the longitudinal direction of the frame body 32.

As illustrated in FIGS. 3 and 4, ends of the outer wall portion 32C and the partition wall portion 32D opposite to the recovery sheet attaching portion 32*g* are closed by an outer wall portion 32F. A flat gap is formed between the outer wall portion 32C and the partition wall portion 32D.

An opening of the toner accommodating portion 32*e* facing the intermediate transfer belt 27 is disposed between the recovery sheet 37 and the cleaning blade 33. The tip end of the recovery sheet 37 and the edge 33*a* of the cleaning blade 33 are in contact with the outer surface of the wound portion of the intermediate transfer belt 27. The exposure portion 27*a*, which is a part of the outer surface of the intermediate transfer belt 27, is a portion between the tip end of the recovery sheet 37 and the edge 33*a* of the cleaning blade 33.

As illustrated in FIG. 3, a ventilation hole 32*d* penetrates through the central portion of the partition wall portion 32D in the longitudinal direction thereof. The ventilation hole 32*d* faces the center position of the image forming region in the width direction in the exposure portion 27*a*.

A ventilation hole 32*c* penetrates the outer wall portion 32C facing the ventilation hole 32*d*. The ventilation hole 32*c* has the same shape as the ventilation hole 32*d*. Thus, the inner surface of the ventilation hole 32*c* is aligned with the inner surface of the facing ventilation hole 32*d*.

A protrusion 32H is formed along the longitudinal direction of the frame body 32 on the inner surface of the partition wall portion 32D. The protrusion 32H protrudes toward the tip end of the cleaning blade 33. According to the present embodiment, the protrusion 32H is positioned above the edge 33*a* of the cleaning blade 33 at the position facing the exposure portion 27*a*. The protrusion 32H is provided at a position along the inner surface of the ventilation hole 32*d* on the lower end side.

An upper surface 32*h* that faces the upper side is formed on the protrusion 32H. The upper surface 32*h* receives toner that is scattered inside the toner accommodating portion 32*e*.

A side wall portion 32B that extends from the outer wall portion 32C to the flat plate portion 32A is formed in a region surrounding the ventilation hole 32*c* on the outer wall portion 32C on which the ventilation hole 32*c* is formed.

The fan accommodating portion 32*a* is formed to be surrounded by the flat plate portion 32A, the side wall portion 32B, and the outer wall portion 32C. A rectangular opening 32*b* is formed on a region of the side wall portion 32B that is parallel to the longitudinal direction of the frame body 32. A filter 38 is attached to the opening 32*b*. The filter 38 catches dust included in the air flow passing therethrough.

The fan 35 is disposed between the opening 32*b* and the ventilation hole 32*c* inside the fan accommodating portion 32*a*. An air inlet 35*a* of the fan 35 faces the opening 32*b*. An air outlet 35*b* of the fan 35 faces the ventilation hole 32*c*. The fan 35 performs intake of air through the air inlet 35*a* from the opening 32*b*. The fan 35 blows the outside air obtained through the intake to the ventilation hole 32*c* from the air outlet 35*b*.

As illustrated in FIG. 2, a rectangular air outlet 32*j* is formed each of end of the outer wall portion 32C in the longitudinal direction thereof. Cross sectional structure of each air outlet 32*j* taken along a line orthogonal to the longitudinal direction of the frame body 32 are identical to each other. As illustrated in FIG. 4, an air outlet 32*k* penetrates the partition wall portion 32D facing the air outlet 32*j*. The air outlet 32*k* has the same shape as the air outlet 32*j*. Thus, the inner surface of the air outlet 32*k* is aligned with the inner surface of the facing air outlet 32*j*.

Two toner filters 36 are disposed in at least two positions, respectively, which are overlapped with the air outlets 32*j* and 32*k* between the outer wall portion 32C and the partition wall portion 32D. The toner filters 36 cover the corresponding air outlets 32*j* and 32*k*, respectively. The respective toner filters 36 catches the toner in an air current that is exhausted from the air outlets 32*j* and 32*k*.

Next, a configuration of an end of the frame body 32 in the longitudinal direction thereof will be described.

From here on, description will be focused on the configuration of the front end of the frame body 32 in the longitudinal direction. Differences of the configuration on the rear side from that on the front side will be described, as necessary.

As illustrated in FIG. 5, a hole portion 32*m* through which the auger 39 is inserted is formed on the front side wall portion 32L. The hole portion 32*m* is inserted through the inside of the waste tonner guide 41 (not illustrated in FIG. 5).

End surfaces 32*n* and 32*p* of the front side wall portion 32L on the intermediate transfer belt 27 side are separated from the intermediate transfer belt 27.

The end surface 32*n* is formed at a position facing the wound portion of the intermediate transfer belt 27. A toner seal 40 that protrudes towards the intermediate transfer belt 27 is attached at the end surface 32*n*. A length of protrusion of the toner seal 40 is greater than that of a gap between the end surface 32*n* and the intermediate transfer belt 27. The toner seal 40 is formed of a material that is elastically deformed in the protrusion direction. The toner seal 40 suppresses passage of the toner in the longitudinal direction of the frame body 32. The toner seal 40 may have air permeability. However, it is preferable that the air permeability of the toner seal 40 be lower than the air permeability of the toner filter 36. The tip end of the toner seal 40 is formed of a material that enables the tip end to be in close contact with the intermediate transfer belt 27 and is smooth.

According to the embodiment, the toner seal 40 includes a felt 40A and a foamed member 40B. The felt 40A is provided on the tip end of the toner seal 40 in the protrusion direction. The felt 40A is in close contact with the outer surface of the intermediate transfer belt 27. When the intermediate transfer belt 27 moves, the felt 40A slides relatively on the outer surface of the intermediate transfer belt 27.

When the felt 40A is tightly in close contact with the intermediate transfer belt 27, the foamed member 40B is compressed. The foamed member 40B presses the felt 40A against the intermediate transfer belt 27.

The end surface 32*p* is a flat surface. The end surface 32*p* is aligned with the holder attaching portion 32*f* of the frame body 32. The end surface 32*p* is extended from the lower end of the end surface 32*n*. Similar to the holder attaching portion 32*f*, the end of the holder 34 is fixed to the end surface 32*p*. The upper end of the holder 34 is in close contact with the lower end surface of the toner seal 40. A side surface 33*c* of the cleaning blade 33 is in contact with the inner side surface of the toner seal 40 in the thickness direction (longitudinal direction of the frame body 32) from the inner side of the frame body 32. The end on the front side of the recovery sheet 37 having the same width as the cleaning blade 33 is in contact with the inner side surface of the toner seal 40 in the thickness direction, which is not illustrated in FIG. 5. Therefore, the end on the front side of the exposure portion 27*a* in the longitudinal direction is sealed by the toner seal 40.

The rear side wall portion 32M has the same configuration as the front side wall portion 32L, which is not illustrated. That is, the toner seal 40 and the holder 34 are fixed to the end surfaces 32*n* and 32*p* of the rear side wall portion 32M, respectively. The rear side end of the exposure portion 27*a* in the longitudinal direction thereof is sealed by the toner seal 40 of the rear side wall portion 32M. However, a connection coupling member that is connected to the end of the auger 39 is inserted into the hole portion 32*m* of the rear side wall portion 32M. The connection coupling member is connected to a drive transmitting mechanism provided on the printer 3 and transmits a rotational force to the auger 39.

Next, description of the image forming apparatus 100 is focused on the effects of the transfer belt cleaning unit 31.

Figure 6:
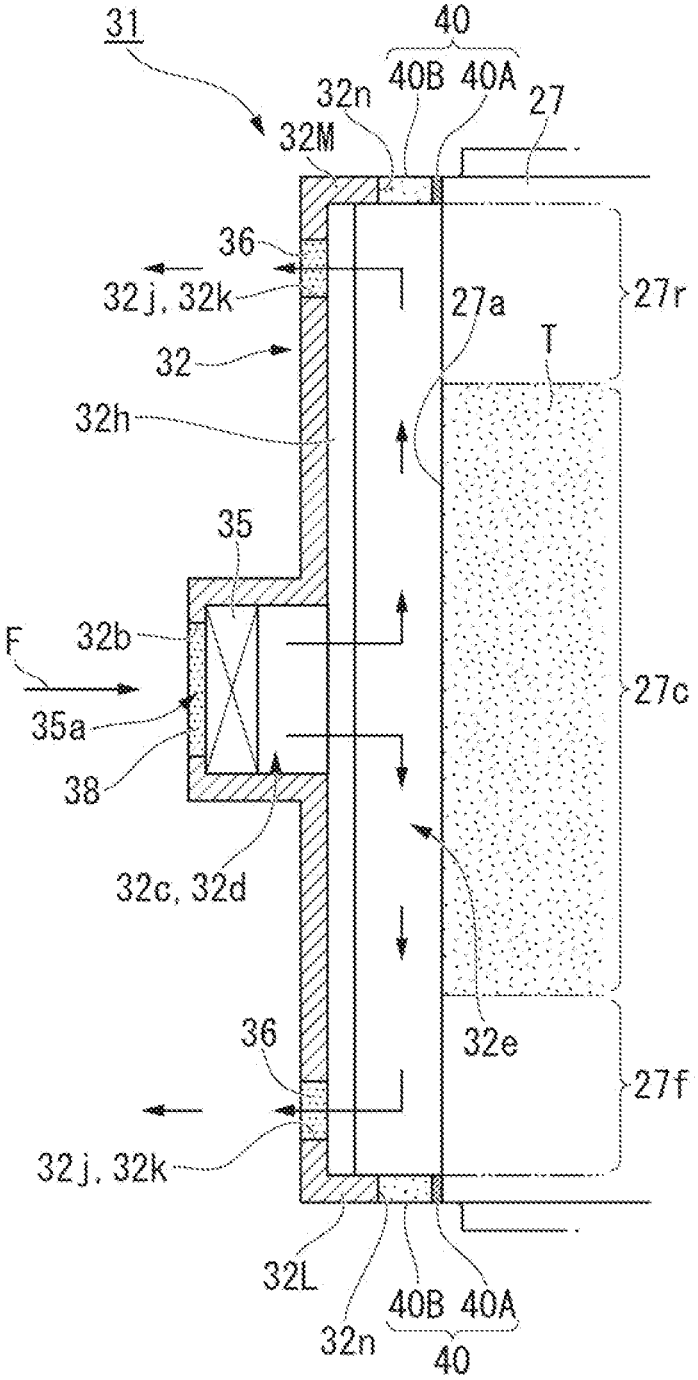
FIG. 6 is a schematic cross-sectional view of a flow path of an air current in the transfer belt cleaning unit of the image forming apparatus according to the first embodiment.
Figure 7:
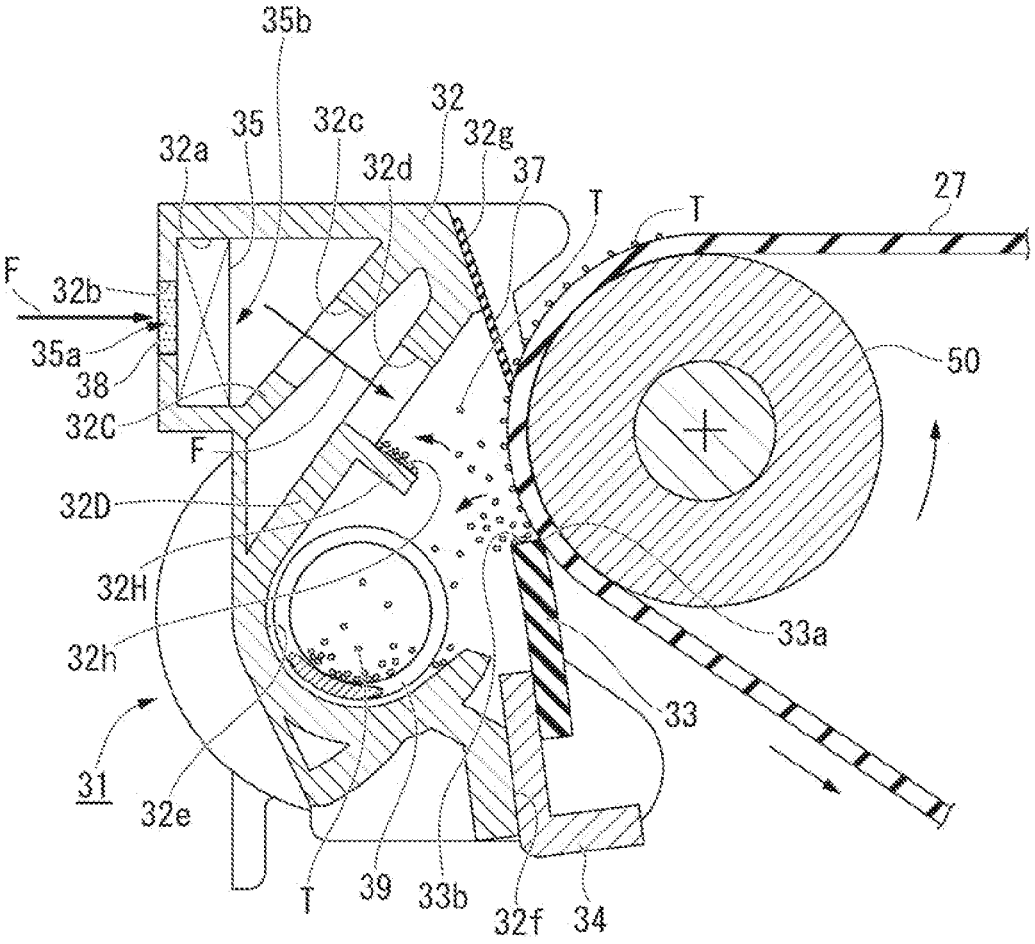
FIG. 7 is a schematic cross-sectional view of the transfer belt cleaning unit under operation.

FIG. 6 is a schematic cross-sectional view of a flow path of an air current in the transfer belt cleaning unit 31 of the image forming apparatus 100 according to the first embodiment. A part of members and sections are not illustrated in FIG. 6. For example, the ventilation holes 32*c* and 32*d* are illustrated as one opening and the air outlets 32*j* and 32*k* are illustrated as one opening, in which the openings communicates with each other. FIG. 7 is a schematic cross-sectional view of the transfer belt cleaning unit 31 that is under operation.

In the transfer belt cleaning unit 31, the tip end of the recovery sheet 37, the edge 33*a* of the cleaning blade 33, and each toner seal 40 are in contact with the intermediate transfer belt 27. The opening of the toner accommodating portion 32*e* on the side of the intermediate transfer belt 27 is closed by the exposure portion 27*a*. The toner seal 40 does not have air permeability or has lower air permeability than the toner filter 36.

Therefore, as illustrated in FIG. 7, in the toner accommodating portion 32*e*, the air current flows in and out substantially through the ventilation holes 32*c* and 32*d* and the air outlets 32*j* and 32*k*.

In the image forming apparatus 100, an image forming operation starts by control of the control panel 1 or an external signal. The image data is transmitted to the printer 3 through reading of a copy target by the scanner 2 or from an external device.

The printer 3 supplies the sheet S having an appropriate size from the sheet container 4 to the registration roller 24.

The image forming units 25Y, 25M, 25C, and 25K form toner images, which are to be transferred onto the sheet S, on the intermediate transfer belt 27 based on the image data in accordance with each color. The toner images are superimposed in order within the width of the image forming region in accordance with the movement of the intermediate transfer belt 27 and is conveyed to the transfer unit 28. The toner image is secondarily transferred onto the sheet S fed from the registration roller 24 to the transfer unit 28. The secondarily transferred toner image is fixed on the sheet S by the fixing device 29.

Meanwhile, a minute amount of toner that is not transferred onto the sheet S by the transfer unit 28 remains on the outer surface of the intermediate transfer belt 27 as post-transfer residual toner. The post-transfer residual toner is located only within the width of the image forming region. As illustrated in FIG. 6, the post-transfer residual toner T is attached on the central portion of the image forming region 27*c* in the width direction of the intermediate transfer belt 27 that is moving toward the transfer belt cleaning unit 31. The post-transfer residual toner T is not attached to non-image forming regions 27*r* and 27*f* on the outer side of the image forming region 27*c* in the width direction of intermediate transfer belt 27.

The toner contains a lubricant to improve durability of the photoreceptor drum 250. Therefore, the post-transfer residual toner T has an effect to decrease the friction between the cleaning blade 33 and the intermediate transfer belt 27. Accordingly, the frictional force acting on the cleaning blade 33 is likely to be greater at the end portions of the cleaning blade 33 than at the central portion of the cleaning blade 33 in the longitudinal direction.

Such difference of the frictional force may cause the cleaning blade 33 to curl. The curling of the cleaning blade 33 causes cleaning failure. Further, as a drive load of the intermediate transfer belt 27 becomes greater, the drive of the intermediate transfer belt 27 may become unstable or unable.

When the image forming apparatus 100 starts forming an image, the fan 35 is caused to rotate.

The fan 35 performs the intake of outside air F from the opening 32*b*. The fan 35 blows the air F into the toner accommodating portion 32*e* through the ventilation holes 32*c* and 32*d*. The air F passes through the filter 38. When dust or the like is contained in the air F, the dust or the like is caught by the filter 38.

The air F blown by the fan 35 is blown against the exposure portion 27*a* located at the center of the image forming region 27*c*. The air outlets 32*j* and 32*k* are provided at each of end portions of the toner accommodating portion 32*e* in the longitudinal direction. Therefore, the air F branches into two currents to the front side (front side wall portion 32L side) and to the rear side (rear side wall portion 32M side) of the toner accommodating portion 32*e* in the longitudinal direction thereof and flows along the longitudinal direction. The both currents of the air F reach the end portions and are exhausted to the outside through each air outlets 32*j* and 32*k*. Each of the air outlets 32*j* and 32*k* is covered with the toner filter 36. The air F passes through each of the toner filters 36. The toner filters 36 catch the post-transfer residual toner T contained in the air F. Therefore, only the air F is exhausted from each air outlet 32*j*. The post-transfer residual toner T remains inside the toner accommodating portion 32*e*.

Flow of the air F (air current) in the toner accommodating portion 32*e* is a normal flow from a position facing the central portion of the image forming region 27*c* to the end portions in the longitudinal direction.

The post-transfer residual toner T scraped by the cleaning blade 33 is stored inside the toner accommodating portion 32*e*.

As illustrated in FIG. 7, when the post-transfer residual toner T is scraped by the edge 33*a* of the cleaning blade 33, the post-transfer residual toner T remains on the tip end surface 33*b*. Therefore, the post-transfer residual toner T drops downward or is scattered upward. According to the embodiment, the flow of the air F is produced in the toner accommodating portion 32*e*. A part of the post-transfer residual toner T in the toner accommodating portion 32*e* moves along the flow of the air F.

Therefore, the post-transfer residual toner T moved along the flow of the air F is attached onto the non-image forming regions 27*f* and 27*r* of the exposure portion 27*a* where the post-transfer residual toner T is not present. Similar to the post-transfer residual toner T attached at the central portion, the post-transfer residual toner T attached at the end portions of the exposure portion 27*a* in the longitudinal direction thereof is scraped by the cleaning blade 33. The post-transfer residual toner T functions as a lubricant between the cleaning blade 33 and the intermediate transfer belt 27. Therefore, compared with when the fan 35 does not perform blowing, the friction at the end portions of the cleaning blade 33 in the longitudinal direction is decreased.

Therefore, the cleaning blade 33 is prevented from being curled in the transfer belt cleaning unit 31. Accordingly, the cleaning failure due to the curling of the cleaning blade 33 can be prevented. Also, the drive load can be prevented from increasing due to the curling of the cleaning blade 33.

According to the embodiment, the air outlets 32*j* and 32*k* are positioned at each of the end portions of the frame body 32 in the longitudinal direction and face each of the non-image forming regions 27*r* and 27*f*. Therefore, the flow of the air F is reliably formed to regions facing the non-image forming regions 27*r* and 27*f*. The post-transfer residual toner T is more likely to be attached to the exposure portion 27*a* corresponding to the non-image forming regions 27*r* and 27*f*.

The protrusion 32H is formed along the longitudinal direction on the inner surface of the toner accommodating portion 32*e*. A part of the post-transfer residual toner T is accumulated on the protrusion 32H when the post-transfer residual toner T is scattered in the toner accommodating portion 32*e*, is stirred upward, and then drops downward. It is possible for the post-transfer residual toner T that is accumulated on the upper surface 32*h* of the protrusion 32H to be scattered a second time due to the flow of the air F. It is possible for the second-time scattered post-transfer residual toner T to be attached to the exposure portion 27*a*.

Since the protrusion 32H is positioned above from the tip end surface 33*b* of the cleaning blade 33, the second-time scattered post-transfer residual toner T is likely to be attached to the exposure portion 27*a* positioned above from the tip end surface 33*b*.

The protrusion 32H extends also towards the end portions in the longitudinal direction, which correspond to the non-image forming regions 27*f* and 27*r*. When the post-transfer residual toner T accumulated on the upper surface 32*h* is not stirred a second time, the post-transfer residual toner moves on the upper surface 32*h* along the flow of the air F. Therefore, more amount of the post-transfer residual toner T is likely to be accumulated also on the upper surface 32*h* at the end portions in the longitudinal direction. When the post-transfer residual toner T accumulated on the upper surface 32*h* of the end portions in the longitudinal direction is stirred a second time, the post-transfer residual toner T is likely to be attached to a particularly faced section of the exposure portion 27*a*.

Since the protrusion 32H extends along the frame body 32 in the longitudinal direction, the protrusion 32H functions to rectify the flow of the air F in the longitudinal direction.

The ends of the frame body 32 in the longitudinal direction are sealed by the toner seal 40, in the transfer belt cleaning unit 31. Therefore, even when the fan 35 performs blowing, the post-transfer residual toner T does not escape from the ends of the frame body 32. Therefore, the transfer belt cleaning unit 31 may prevent toner from scattering inside the printer 3.

The toner seal 40 has a lower air permeability than the toner filter 36. The entire or majority of flow of the air F changes a course thereof at the end portions of the toner accommodating portion 32*e* toward the toner filter 36. The flow of the air F is disturbed. The post-transfer residual toner T transported by the air F is more likely to be attached to the exposure portion 27*a*.

Hereinafter, a modification example according to the first embodiment will be described.

In the image forming apparatus 100 according to the first embodiment described above, the fan 35 is disposed at a position facing the center of the image forming region 27*c*. However, the disposition of the fan 35 is not limited thereto. For example, the fan 35 may be disposed at a position that is shifted from the center of the image forming region 27*c* in the width direction towards the end of the image forming region 27*c*.

In the image forming apparatus 100 according to the first embodiment described above, the blowing direction of the fan 35 is a direction orthogonal to the width direction of the intermediate transfer belt 27. However, the blowing direction of the fan 35 may be an oblique direction with respect to the width direction of the intermediate transfer belt 27.

There is no need to blow directly to the intermediate transfer belt 27 from the fan 35. For example, a duct may be provided at a blowing port of the fan 35. The disposition or direction of an opening of a tip end of the duct makes it possible to set a blowing position and a blowing direction. In this case, since flexibility of the disposition of the fan 35 becomes high, it is possible to save space for the transfer belt cleaning unit 31.

The number of the openings of the duct is not limited to one. An air current by the fan 35 branches and may be blown from a plurality of the openings.

In the image forming apparatus 100 according to the first embodiment described above, the fan 35 is fixed to the frame body 32. However, the fan 35 may not be fixed to the frame body 32. For example, the fan 35 may be fixed to the printer 3. In this case, the transfer belt cleaning unit 31 without the fan 35 is disposed such that the opening 32*b* faces the fan 35. Further, the side wall portion 32B may be removed from the transfer belt cleaning unit 31. In this case, the transfer belt cleaning unit 31 is disposed such that the air outlet 32*j* faces the fan 35. In any cases, the filter 38 may be provided in the frame body 32.

Second Embodiment

Hereinafter, an image forming apparatus 101 according to a second embodiment will be described with reference to the drawings. In the drawings, the same configurations have the same reference numerals. The same configurations as those in the first embodiment have the same reference numerals as those in the first embodiment and description thereof is not repeated.

Figure 8:
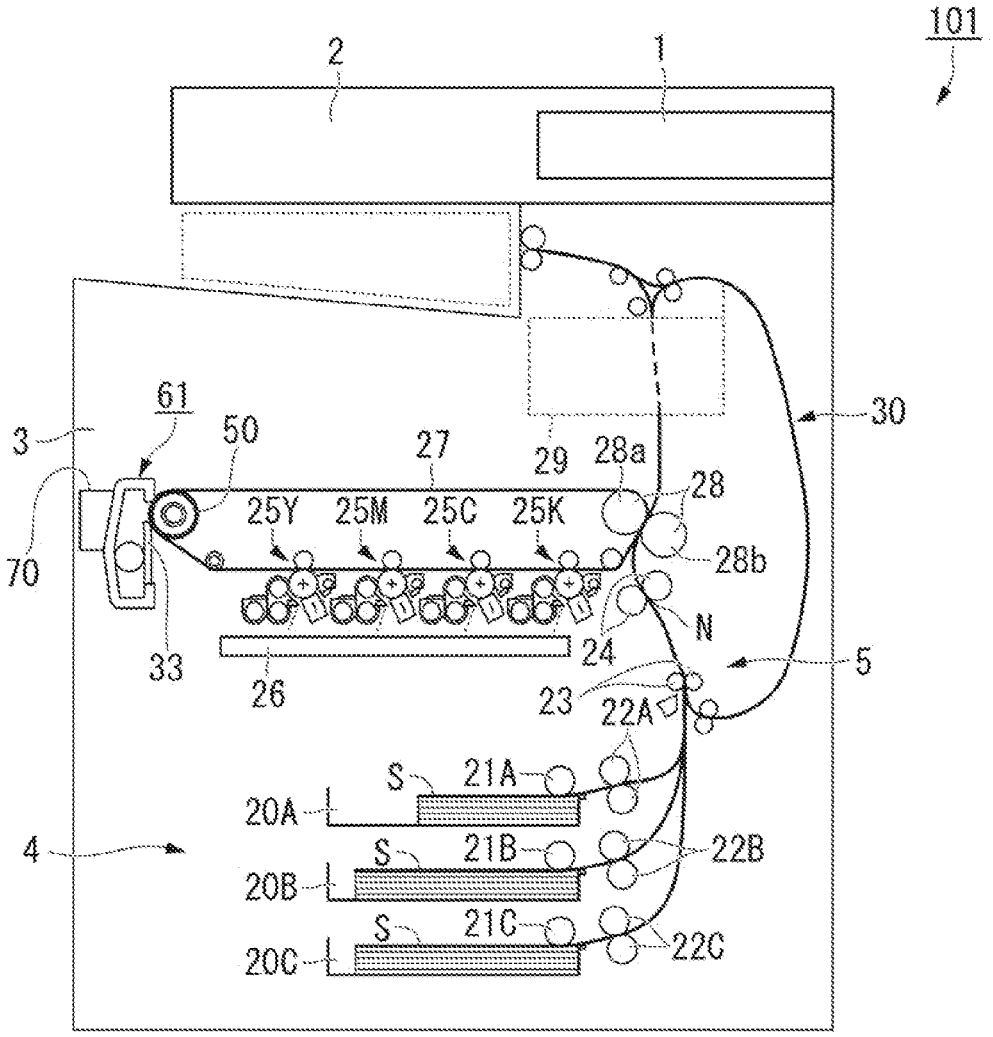
FIG. 8 is a schematic cross-sectional view of an image forming apparatus according to a second embodiment.
Figure 9:
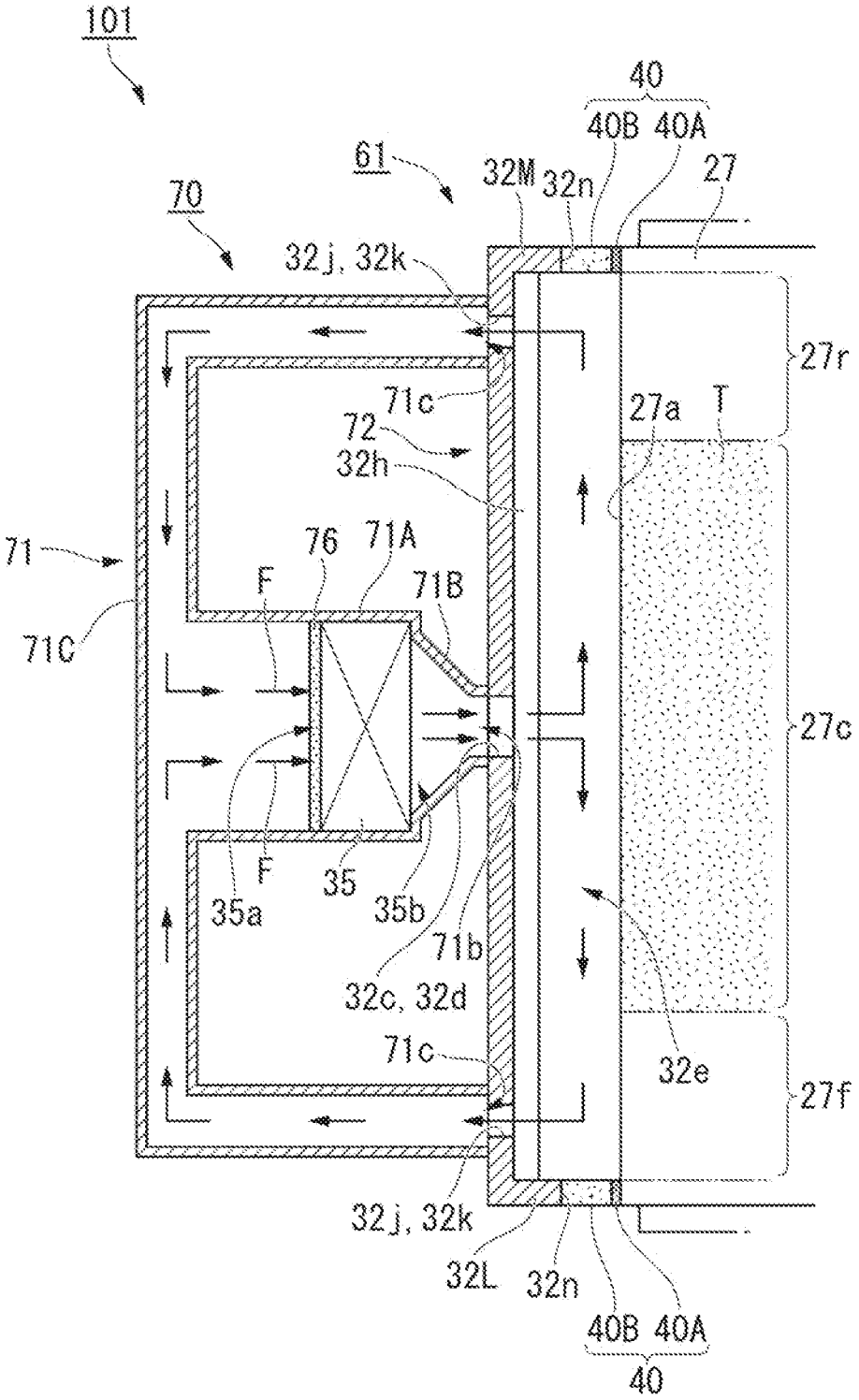
FIG. 9 is a schematic cross-sectional view of components of the image forming apparatus according to the second embodiment.

FIG. 8 is a schematic cross-sectional view of the image forming apparatus according to the second embodiment. FIG. 9 is a schematic cross-sectional view of components of the image forming apparatus according to the second embodiment. Apart of members and sections are not illustrated in FIG. 9. For example, the ventilation holes 32*c* and 32*d* are illustrated as one opening, and the air outlets 32*j* and 32*k* are illustrated as one opening, in which the openings communicate with each other.

As illustrated in FIG. 8, the image forming apparatus 101 includes a transfer belt cleaning unit 61 instead of the transfer belt cleaning unit 31 of the image forming apparatus 100 according to the first embodiment described above. Further, the image forming apparatus 101 includes a blowing unit 70.

As illustrated in FIG. 9, the transfer belt cleaning unit 61 includes a frame body 72 instead of the frame body 32 of the transfer belt cleaning unit 31 of the image forming apparatus 100 according to the first embodiment described above. Further, the fan 35, the filter 38, and the toner filters 36 in the transfer belt cleaning unit 31 are not provided in the transfer belt cleaning unit 61. The other configurations of the transfer belt cleaning unit 61 are the same as those of the transfer belt cleaning unit 31.

The side wall portion 32B of the frame body 32 according to the first embodiment is not provided in the frame body 72.

The blowing unit 70 includes a duct 71, a fan 35, and a toner filter 76.

The duct 71 is disposed adjacent to the transfer belt cleaning unit 61 in the printer 3. The duct 71 includes a fan accommodating portion 71A, an air blowing duct 71B, and an air intake duct 71C.

The fan accommodating portion 71A accommodates the same fan 35 as in the first embodiment described above. The fan accommodating portion 71A includes a pipe line through which an air current flows to an air inlet 35*a* of the fan 35.

The air blowing duct 71B is connected to an end of the fan accommodating portion 71A and in contact with the air outlet 35*b* of the fan 35. The air blowing duct 71B forms a pipe line through which the flow of the air F exhausted from the fan 35 is guided. An air blowing port 71*b* through which the air F is exhausted is formed at an end portion opposite to the fan accommodating portion 71A in the air blowing duct 71B.

The air blowing port 71*b* has a size enough to cover the ventilation hole 32*c* of the frame body 72. The end of the air blowing duct 71B at which the air blowing port 71*b* is formed covers the ventilation hole 32*c* and is in close contact with an outer surface of the frame body 72 around the opening 32*b*. A seal may be provided around the air blowing port 71*b* at the end of the air blowing duct 71B. For example, the seal is formed of a foamed material having elasticity. In this case, the end of the air blowing duct 71B at which the air blowing port 71*b* is formed presses the outer surface of the frame body 72 through the seal.

The air intake duct 71C is a pipe line through which the air current exhausted from each air outlet 32*j* of the frame body 72 is guided to the fan accommodating portion 71A. End portions of the air intake duct 71C are disposed at positions facing the air outlets 32*j* of the frame body 72, respectively. In the air intake duct 71C, an air inlet 71*c* is formed at each of the end portions facing the air outlet 32*j*, respectively.

Each air inlet 71*c* has a size enough to cover each air outlet 32*j* of the frame body 72. The end portions of the air intake duct 71C cover the air outlets 32*j*, respectively. The end portions of the air intake duct 71C are in close contact with the outer surface of the frame body 72 around the air outlets 32*j*. A seal may be provided around the air inlets 71*c* at the end portions of the air intake duct 71C. For example, the seal is formed of a foamed material having elasticity. In this case, the end portions of the air intake duct 71C presses the outer surface of the frame body 72 through the seal.

The middle portion of the air intake duct 71C is connected to an end portion of the fan accommodating portion 71A that is opposite to the end at which the air blowing duct 71B is connected. The air intake duct 71C communicates with the fan accommodating portion 71A.

According to such a configuration, the duct 71 communicates with the air outlets 32*j* of the transfer belt cleaning unit 31. Further, the duct 71 guides the flow of the air F from the air outlets 32*j* to the air inlet 35*a* of the fan 35. The fan 35 sucks the air F from the air inlet 35*a* and exhausts the air F to the air blowing duct 71B from the air outlet 35*b*. The air F exhausted to the air blowing duct 71B is blown into the ventilation holes 32*c* and 32*d* of the frame body 72 through the air blowing port 71*b*. Similarly to that in the first embodiment described above, the air F that has passed through the ventilation holes 32*c* and 32*d* flow to the end portions of the toner accommodating portion 32*e*. The air F that reaches the end portions of the toner accommodating portion 32*e* flows into the air intake duct 71C through each of the air outlets 32*k* and 32*j*.

Therefore, the duct 71 forms a circulation flow path of the air F.

Such a blowing unit 70 is fixed to the printer 3. The transfer belt cleaning unit 61 is attachable to and detachable from the printer 3 in the longitudinal direction of the transfer belt cleaning unit 61.

The image forming apparatus 101 includes the blowing unit 70. When the fan 35 rotates during the image forming operation, the flow of the air F that circulates normally is formed in the blowing unit 70 and the toner accommodating portion 32*e* of the frame body 72. The air current in the toner accommodating portion 32*e* is the same as the current in the toner accommodating portion 32*e* according to the first embodiment. Therefore, effects of the air current in the toner accommodating portion 32*e* are the same as in the first embodiment.

According to the embodiment, further, the air F that contains the post-transfer residual toner T and is exhausted from the air outlets 32*j* flows through the duct 71. The air F circulates through the duct 71 and the toner accommodating portion 32*e*. At this time, the post-transfer residual toner T in the air F is caught by the toner filter 76 disposed in the fan accommodating portion 71A. Therefore, no toner filter may be provided in the transfer belt cleaning unit 61. Further, there is no need to include a fan that produces an air current in the frame body 72. Therefore, a configuration of the transfer belt cleaning unit 61 is simplified, when compared with the transfer belt cleaning unit 31 according to the first embodiment described above.

Hereinafter, a modification example of the second embodiment will be described.

In the image forming apparatus 101 according to the second embodiment described above, the transfer belt cleaning unit 61 does not include the filter 38 and toner filters 36 according to the first embodiment. However, toner filters may be disposed between the ventilation holes 32*c* and 32*d* and between the air outlets 32*j* and 32*k* in the transfer belt cleaning unit 61, respectively. In this case, when the transfer belt cleaning unit 61 is detached from the printer 3, toner in the frame body 72 is unlikely to be scattered to the outside.

In the image forming apparatus 101 according to the second embodiment described above, the transfer belt cleaning unit 61 may move with respect to the blowing unit 70 in the longitudinal direction of the transfer belt cleaning unit 61. However, the blowing unit 70 may be fixed to the frame body 72. For example, the duct 71 may be formed in a part of the frame body 72.

Figure 10:
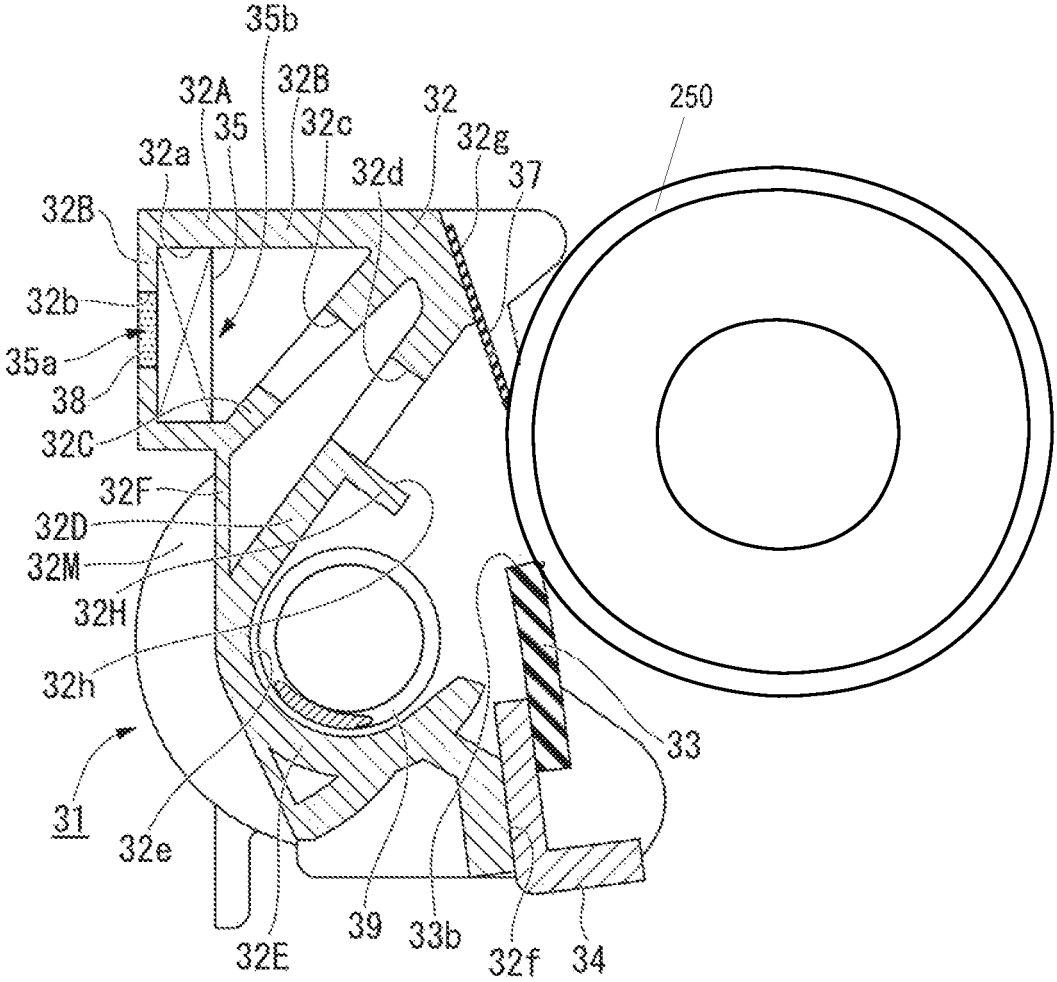
FIGS. 10 and 11 each are a schematic cross-sectional view of a cleaning unit applied to a photoreceptor drum as a photoreceptor cleaning unit.
Figure 11:
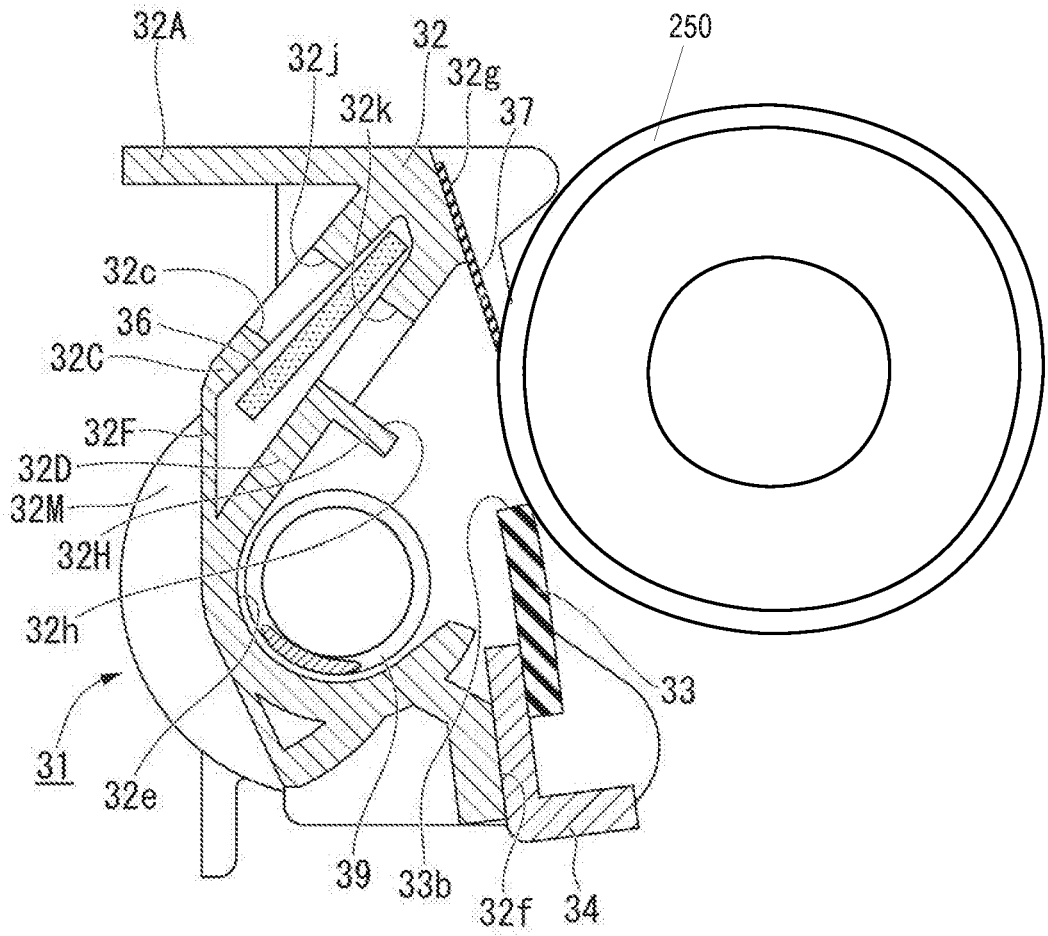

In the first and second embodiments described above, the image carrier is the intermediate transfer belt 27, and the cleaning blade is the cleaning blade 33 that cleans the intermediate transfer belt 27. Alternatively, the configuration of the transfer belt cleaning units 31 and 61 in the first and second embodiments may be applied to a cleaning unit of the photoreceptor drum 250 that holds a toner image as shown in FIGS. 10 and 11. That is, the image carrier may be the photoreceptor drum 250.

According to at least one of the embodiments described above, the image forming apparatus includes the cleaning blade and the frame body that holds the cleaning blade and surrounds the cleaning blade and the front surface of the image carrier which is in contact with the cleaning blade. Further, the image forming apparatus includes the fan that forms the air current flowing from a position facing the image forming region on the image carrier towards end portions of the cleaning blade in the longitudinal direction thereof. Therefore, the toner is attached even to the outside of the image forming region of the image carrier. The attached toner causes the friction on the end portions of the cleaning blade in the longitudinal direction against the image carrier to be decreased. As a result, the cleaning blade is prevented to be curled.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A cleaning apparatus for an image carrier with toner thereon, comprising:

a cleaning member that is in contact with the image carrier and configured to remove toner on the image carrier as the image carrier moves in a conveying direction;

an air blower configured to generate an air flow in a region of the image carrier that is moving towards the cleaning member;

a main body that encloses the region of the image carrier, and has an opening through which the air flows out of the main body; and a duct that guides the air flowing out of the main body to the air blower; and the image carrier has a first region with toner thereon and a second region with no toner thereon, along a width direction thereof, and the air blower generates the air flow such that the toner on the first region is dispersed onto the second region by the air flow.

2. The cleaning apparatus according to claim 1, wherein the cleaning member is in contact with both the first and second regions of the image carrier.

3. The cleaning apparatus according to claim 1, wherein the region of the image carrier is a center region of the image carrier in a width direction thereof.

4. The cleaning apparatus according to claim 1, further comprising:

a toner filter disposed at the opening.

5. The cleaning apparatus according to claim 1, further comprising:

a covering member that is disposed at an end region of the image carrier in a width direction of the image carrier and is disposed in a space enclosed by the main body to cover the end region.

6. The cleaning apparatus according to claim 1, wherein the main body has a protrusion that extends in a width direction of the main body, and protrudes into a space enclosed thereby.

7. An image forming apparatus comprising:

an image forming unit that includes an image carrier and is configured to form a toner image on the image carrier, a surface of the image carrier being configured to move in a conveying direction through a transfer position at which the toner image thereon is transferred;

a fixing unit configured to fix the toner image transferred onto a medium; and a cleaning unit configured to remove toner on a portion of the image carrier that has passed the transfer position, as the image carrier moves in the conveying direction;

wherein the cleaning unit includes a cleaning member that is in contact with the image carrier and configured to remove the toner on the image carrier as the image carrier moves in the convening direction, an air blower configured to generate an air flow in a region of the image carrier that is moving towards the cleaning unit, a main body that encloses the region of the image carrier, and has an opening through which the air flows out of the main body, and a duct that quires the air flowing out of the main body to the air blower; and the image carrier has a first region with toner thereon and a second region with no toner thereon, along a width direction thereof, and the air blower generates the air flow such that the toner on the first region is dispersed onto the second region by the air flow.

8. The image forming apparatus according to claim 7, wherein the image forming unit includes a photoreceptor configured to hold the toner image and a transfer belt configured to receive the toner image from the photoreceptor and convey the toner image to the transfer position, and the image carrier is the transfer belt.

9. The image forming apparatus according to claim 8, wherein the image forming unit further includes a roller that is in contact with an inner surface of the transfer belt, and the region of the image carrier is an outer surface of the transfer belt that is opposite to the inner surface that is in contact with the roller.

10. The image forming apparatus according to claim 7, wherein the cleaning unit is in contact with both the first and second regions of the transfer belt.

11. The image forming apparatus according to claim 7, wherein the image forming unit includes a photoreceptor configured to hold the toner image formed in accordance with an electrostatic latent image formed thereon, and the image carrier is the photoreceptor.

12. A method for cleaning an image carrier with toner thereon, comprising:

moving the image carrier with toner thereon towards a cleaning member that is in contact with the image carrier, such that the toner is removed by the cleaning member; and generating with an air blower an air flow in a region of the image carrier that is moving towards the cleaning member and is enclosed by an enclosure that has an opening, the opening being connected to a duct that guides the air flowing out through the opening to the air blower; and the image carrier has a first region with toner thereon and a second region with no toner thereon, in a width direction thereof, and the air flow is generated such that the toner on the first region is dispersed onto the second region by the air flow.

13. The method according to claim 12, wherein the cleaning member is in contact with both the first and second regions of the image carrier.

14. The method according to claim 12, wherein the region of the image carrier is a center region of the image carrier in a width direction thereof.

* * * * *